United States Patent [19]

Noguchi et al.

[11] Patent Number: 4,552,314

[45] Date of Patent: Nov. 12, 1985

[54] METHOD AND APPARATUS FOR FIXING AN END OF A COILED WIRE ON A TAKE UP SPOOL

[75] Inventors: Masahisa Noguchi, Chiba; Kazuji Kaneda, Ichihara, both of Japan

[73] Assignee: The Furukawa Electric Co., Ltd., Tokyo, Japan

[21] Appl. No.: 573,872

[22] Filed: Jan. 25, 1984

[51] Int. Cl.[4] ..... B65H 75/28

[52] U.S. Cl. ..... 242/25 R; 242/125.1

[58] Field of Search ..... 242/18 R, 18 A, 18 EW, 242/25 R, 25 A, 35.6 R, 35.6 E, 125.1, 125.2; 57/353; 87/3, 24; 289/14, 17

[56] References Cited

U.S. PATENT DOCUMENTS

| | | | |
|---|---|---|---|
| 2,971,712 | 2/1961 | Jacobs, Jr. et al. | 242/25 A |
| 3,441,229 | 4/1969 | Henrich | 242/25 A |
| 4,015,785 | 4/1977 | Ikegami et al. | 242/25 A |
| 4,761,030 | 9/1973 | Leinonen et al. | 242/25 A |

*Primary Examiner*—Leonard D. Christian

*Attorney, Agent, or Firm*—Pearne, Gordon, Sessions, McCoy, Granger & Tilberry

[57] ABSTRACT

This invention relates to a method of fixing an end of a coiled wire on a take up spool and an apparatus therefor.

When the wire is wound on the take up spool, an initiating end of the wire is caught by a catching pawl such as a snagger on a catching plate (snagger plate) which integrally rotates together with the take up spool and thereafter it is wound on the take up spool. Before or immediately before wire winding on the take up spool ends, a wire introduction cover advances to cover the filled take up spool. At that time, a terminating end of the wire on the filled take up spool is so led as to run along the inner surface of the wire introduction cover and come close to the catching plate. Wire drawing lever means on a wire drawing plate draws up the terminating end of the coiled wire to catch it on the catching pawl so that the initiating and terminating ends of the coiled wire intersect on the catching plate. Thereafter, the intersecting portions of the initiating and terminating ends of the wire are fixed to each other.

17 Claims, 17 Drawing Figures

METHOD AND APPARATUS FOR FIXING AN END OF A COILED WIRE ON A TAKE UP SPOOL

BACKGROUND OF THE INVENTION

A terminating end of a coiled wire on a take up spool should be fixed so that it is not loose during its subsequent carriage and storage. In one of the prior arts, the terminating end of the coiled wire, which is relatively thinner, is secured by adhesive tape to the wire coil. However, in this prior art, since the adhesive tape has to be clearly removed when the wire is manipulated in the next step, the operation is troublesome. In addition thereto, the portion of the wire coil from which the adhesive tape is removed tends to be dirty. Furthermore, the adhesive tape is difficult to be adhered to the surface of the wire coil on which there is moisture and even though it is adhered, it tends to be disadvantageously removed. In case the wire has much rigidity, other complicated fixing means is required because it cannot be fixed by the adhesive tape.

SUMMARY OF THE INVENTION

Accordingly, it is a principal object of the invention to provide a method of fixing a terminating end of a coiled wire adapted to easily and rigidly fix the end of the coiled wire even though it has much rigidity.

It is another object of the invention to provide an apparatus for fixing a terminating end of a coiled wire adapted to easily and rigidly fix the end of the coiled wire even though it has much rigidity.

It is another object of the invention to provide an apparatus for binding initiating and terminating ends of a coiled wire to each other so that the terminating end of the coiled wire is positively fixed without any damage due to heat.

In accordance with one aspect of the invention, there is provided a method of fixing a terminating end of a coiled wire on a take up spool on a wire take up apparatus which comprises a catching plate integrally rotating with said wire take up spool and having a catching pawl to catch an initiating end of the wire to be coiled on said wire take up spool, said method comprising the steps of;

relatively advancing a wire introduction cover and said wire take up spool so that said spool is within the cover when wire winding on said take up spool nearly ends;

introducing said terminating end of said wire along an inner face of said wire introduction cover to reach said catching plate;

catching said terminating end of said wire with said catching pawl by a wire drawing member on a wire drawing plate which is positioned close to said wire take up spool so that said initiating and terminating ends of said wire intersect on said catching plate;

and fixing intersecting portions of said initiating and terminating ends of said wire to each other.

In accordance with another aspect of the invention, there is provided an apparatus for fixing a terminating end of a coiled wire on a take up spool wire on a wire take up apparatus which comprises a catching plate integrally rotating with said take up spool and having a catching pawl to catch an initiating end of the wire to be coiled on said take up spool, said apparatus characterized by that said catching pawl has a catching portion to catch said terminating end of said coiled wire and further comprising wire introduction means including a wire introduction cover disposed so as to cover said catching plate and said take up spool and having means to introduce said terminating end of said wire toward said catching pawl so that said initiating and terminating ends of said wire intersect and a power source to relatively move said wire introduction cover and said spool between an advanced position in which said wire introduction cover surrounds said take up spool and a retracted position in which said take up spool is relieved out of said wire introduction cover; and means to fix intersecting portions of said initiating and terminating ends of said wire to each other.

BRIEF DESCRIPTION OF THE DRAWINGS

The above and other objects and features of the invention will be apparent from the description of the embodiments taken along with reference to the accompanying drawings in which.

DETAILED DESCRIPTION OF THE EMBODIMENTS

Figure 1:
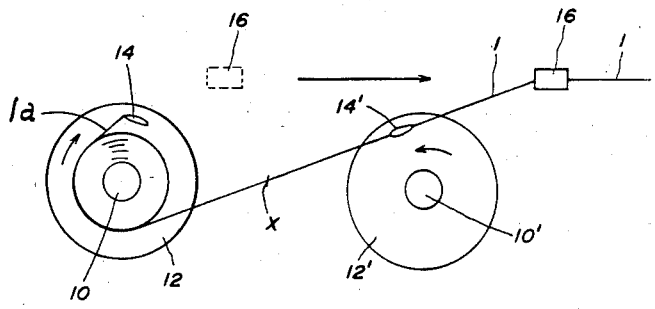
FIG. 1 is a view which schematically illustrates a double spooler.

Refering now to FIG. 1, there is shown a double spooler type wire take up apparatus to which the invention is applied. The wire take up apparatus comprises two take up sections supporting take up spools 10 and 10'. A wire 1 is alternately wound on the take up spools 10 and 10'. Catching (or snagger) plates 12 and 12' having catching pawls such as snaggers 14 and 14', respectively, are mounted on the apparatus so that they are integrally rotated together with the take up spools 10 and 10', respectively.

A wire 1 such as a thin electric wire, bare or insulated, is wound up on the spool 10, for example, while it is distributed by a distributor 16. Before or immediately before the wire 1 is fully wound up on the take up spool 10, that is, when wire winding nearly ends, the distributor 16 is transferred from a dotted line position to the solid line position in FIG. 1. At that time, the spool 10' begins to rotate so that the wire 1 is caught by the catching pawl 14' on the catching plate 12'. Simultaneously, the wire 1 is cut at the position x by a cutter, not shown. Thus, it will be noted that the wire 1 is continuously wound up on the spool 10'.

Figure 3:
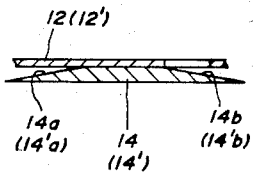
FIG. 3 is a cross sectional view of a catching plate with a portion broken away.
Figure 2:
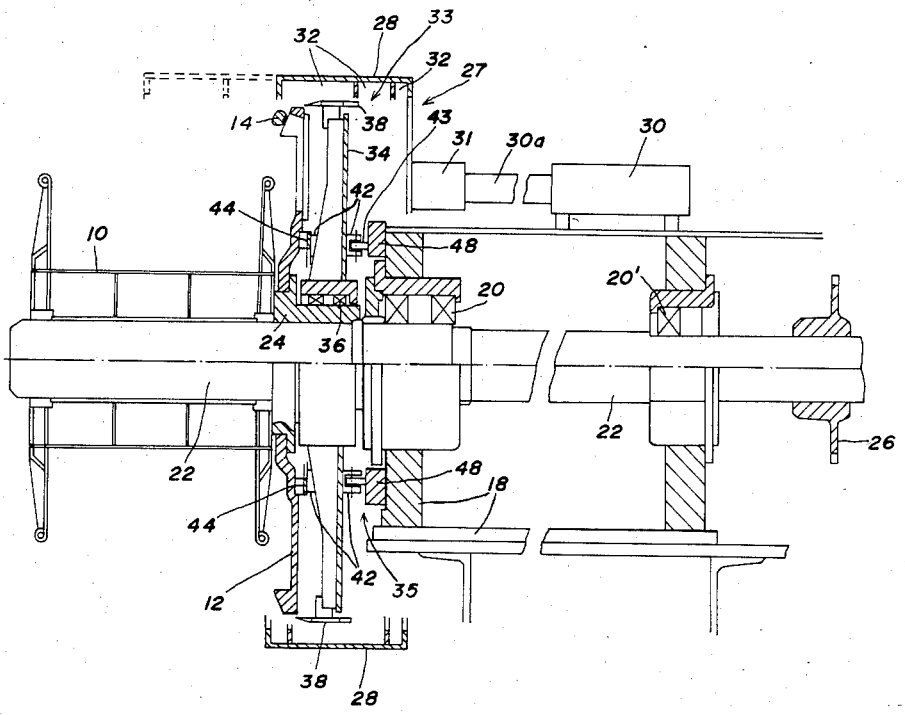
FIG. 2 is a cross sectional view of an apparatus for fixing a terminating end of a coiled wire.

FIG. 2 illustrates one of the wire take up sections having the take up spool 10 in detail, but the other wire take up section for spool 10' is constructed in an identical manner. The take up spool 10 is supported by a spindle 22 which is in turn rotatably supported by bearings 20 and 20' on a frame 18. The catching plate 12 is secured through a collar 24 to the spindle 22. The spindle 22 has a sprocket (or pulley) 26 mounted at the rightward end thereof. The sprocket 26 is driven by a power source such as an electric motor, not shown, through a chain (or belt) also not shown to rotate the spindle 22. As shown in FIG. 3, the catching pawl 14 (or 14') has two pawl portions of tapered faces 14*a* and 14'*a* (or 14'*a* and 14'*b*) to catch terminating and initiating ends of the wire 1 between the pawl portions and the catching plate 14 and 14'. It should be noted that although, in the illustrated embodiment, two pawl portions of the catching pawl 14 (or 14') are integrally provided, they may be separately provided.

Figure 4:
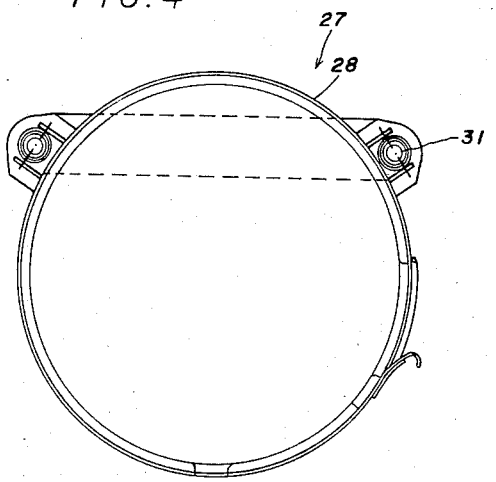
FIGS. 4 and 5 are enlarged front and cross sectional views of wire introduction means, respectively.
Figure 5:
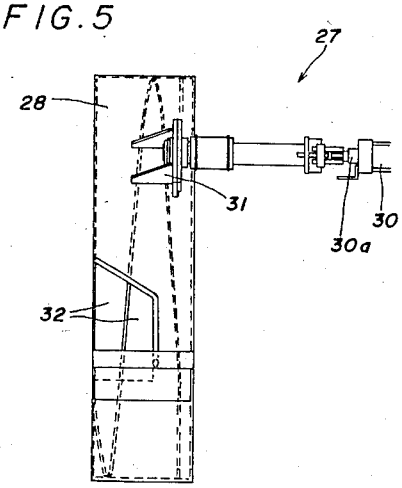

Wire introduction means 27 comprises a wire introduction cover 28 disposed to cover the catching plate 12 and the take up spool 10 and a power source 30 to drive the wire introduction cover 28 between an advanced position (a dotted line position in FIG. 2) in which the take up spool 10 is covered and a retracted position (a solid line position in FIG. 2) in which the take up spool 10 is opened. In the illustrated embodiment, the power source 30 may be cylinders mounted on the frame 18. As shown in FIGS. 2, 4 and 5, the cylinders have piston rods 30*a* connected through arms 31 to the wire introduction cover 28 on both sides thereof. As shown in FIGS. 2 and 5, the wire introduction cover 28 has means to transfer the wire 1 toward the catching plate 12. In the embodiment of FIG. 2, the transferring means comprises a spiral wire guide 32 provided on the inner surface of the wire introduction cover 28. Thus, when the terminating end of the wire 1 rotates within the wire introduction cover 28 in the advanced position, it is transferred along the spiral wire guide 32 by centrifugal force in a rightward direction as viewed in FIGS. 2 and 5 and then caught by the catching pawl 14.

Figure 14:
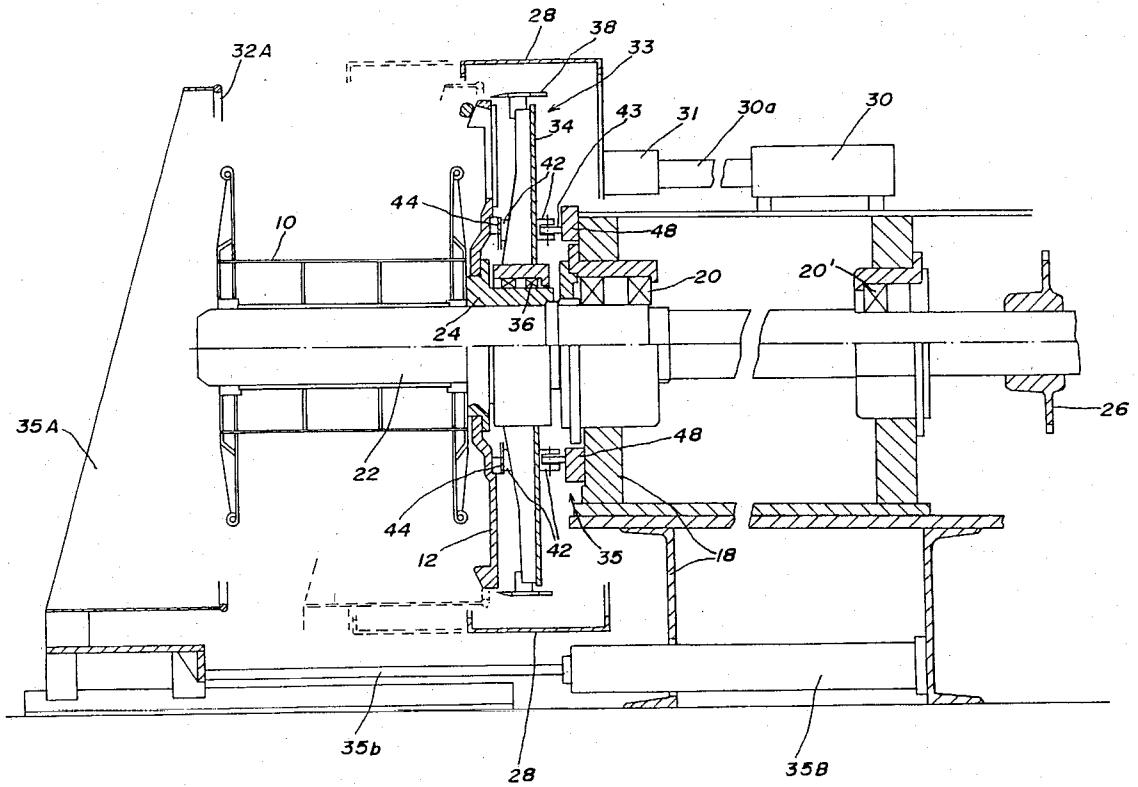
FIG. 14 is a cross sectional view of an apparatus of the invention in which wire introduction means is modified.

Although the transferring means comprises the spiral wire guide 32 in the embodiment of FIG. 2, it may comprise a circular ring 32A as shown in FIG. 14. In the embodiment of FIG. 14, the circular ring 32A may be connected through a bracket 35A to a piston rod 35*b* of a cylinder 35B which is in turn mounted on the frame 18. It will be understood that, in the embodiment of FIG. 14, the spiral wire guide 32 is omitted.

Figure 6:
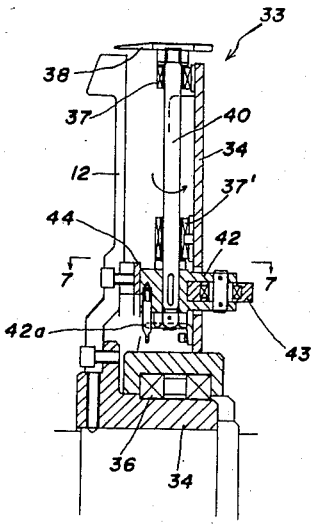
FIG. 6 is a cross sectional view of wire drawing means with a half portion omitted.
Figure 7:
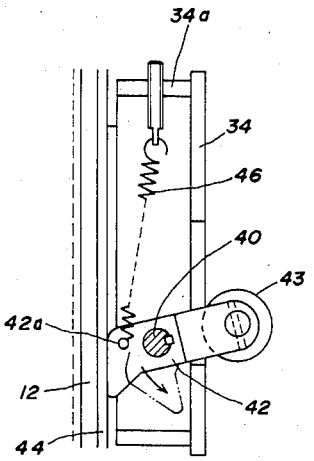
FIG. 7 is a cross section view of the wire drawing means of FIG. 6 taken along the line 7–7 thereof.
Figure 8:
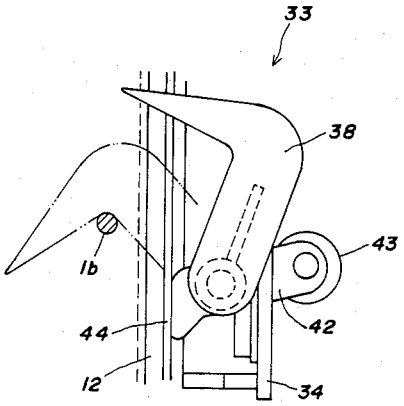
FIG. 8 is a side elevational view of the wire drawing means of FIG. 8.

Wire drawing means 33 serves to draw up the terminating end of the wire 1 toward the catching pawl 14 on the catching plate 12. The drawing means 33 comprises a wire drawing plate 34 disposed near the catching plate 12 on the outside thereof and rotatably supported by a bearing 36 on the collar 24, a clutch 35 to engagably join the wire drawing plate 34 with the catching plate 12 and wire drawing levers 38 to hook the terminating end of the wire 1. As shown in FIGS. 6 through 8, the wire drawing plate 34 has rotatable shafts 40 rotatably supported by bearings 37 and 37' on the wire drawing plate 34. The wire drawing levers 38 are secured to the rotatable shafts 40 at the upper end thereof.

The clutch 35 has clutch levers 42 secured to the rotatable shafts 40 at the inner end thereof. As shown in FIGS. 6 and 7, the clutch levers 42 are moved between a clutch engaging position in which the clutch levers 42 are forced against a frictional plate 44 on the catching plate 12 to rotate together with the catching plate 12 and a clutch disengaging position in which the clutch levers 42 are disengaged from the frictional plate 44 to rotate separately from the catching plate 12. Spring 46 is provided between a rib 34*a* of the wire drawing plate 34 and a pin 42*a* of the clutch levers 42 to urge the clutch levers 42 to be moved toward the clutch engaging position. As seen from FIG. 8, the wire drawing levers 38 are in the solid line position in the clutch engaging position of the clutch levers 42, but when the clutch levers 42 are moved to the clutch disengaging position as shown by an arrow in FIG. 7, the wire drawing levers 38 are rotated in a counterclockwise direction of FIG. 8 to an advanced position as shown by a dotted line in FIG. 8, in which the terminating end 1*b* of the wire 1 is drawn up toward the catching pawl 14 by the drawing levers 38.

Figure 9:
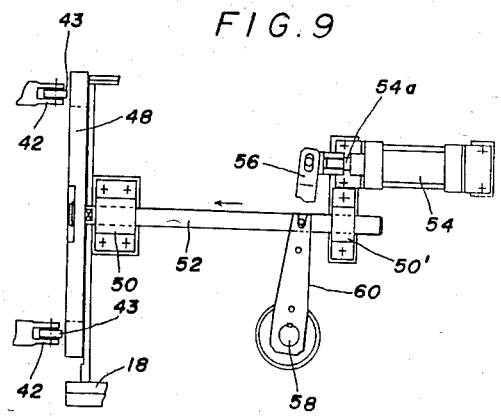
FIG. 9 is a side elevational view of a clutch relief mechanism.
Figure 10:
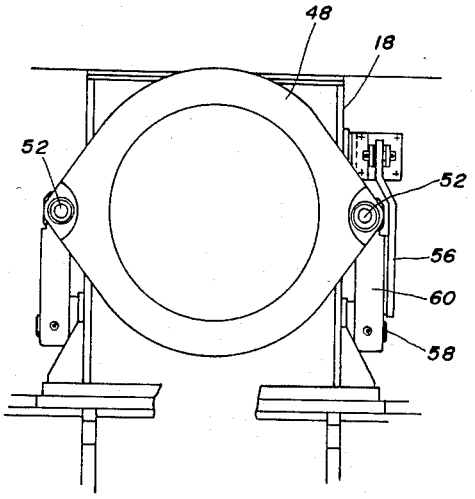
FIG. 10 is a front view of the clutch relief mechanism of FIG. 9.
Figure 11:
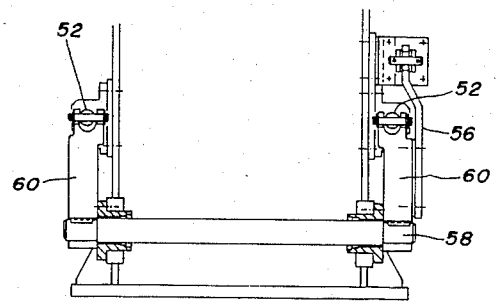
FIG. 11 is cross sectional view of a portion of the clutch mechanism of FIG. 9.

The clutch 35 further comprises a disengaging plate 48 to drive the clutch levers 42 to the clutch disengaging position. As shown in FIGS. 9 through 11, the clutch disengaging plate 48 engages rollers 43 mounted on the clutch levers 42 at the rear ends thereof and has a pair of slidable shafts 52 supported by bearings 50 and 50' on the frame 18. The drive shafts 52 engage levers 60 which are in turn secured to shafts 58 supported on the frame 18. One of the levers 60 is secured to a lever 56 which is in turn joined with a piston rod 54*a* of a cylinder 54 mounted on the frame 18. Thus, when the piston rod 54*a* of the cylinder 54 is contracted, the shaft 58 is rotated in a clockwise direction in FIG. 9 so that the clutch disengaging plate 48 is retracted so as to disengage from the rollers 43. Therefore, the clutch levers 42 are moved to the clutch engaging position and, at the same time, the wire drawing levers 38 are retracted. Conversely, when the piston rod 54*a* of the cylinder 54 is extended, the clutch levers 42 are moved to the clutch disengaging position while the wire drawing levers 38 are moved to the advanced position.

Figure 12:
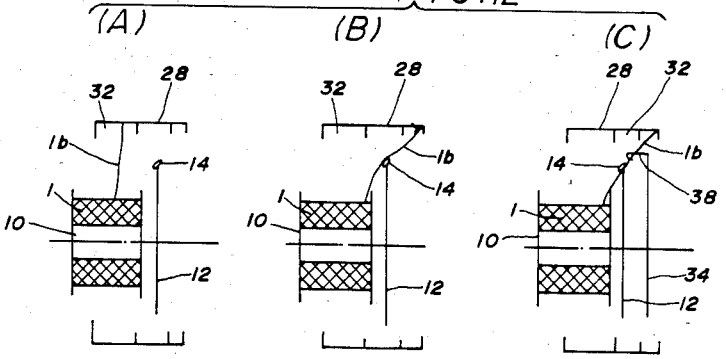
FIGS. 12(A) through (C) schematically and sequentially illustrate the operation of the apparatus of the invention.
Figure 13:
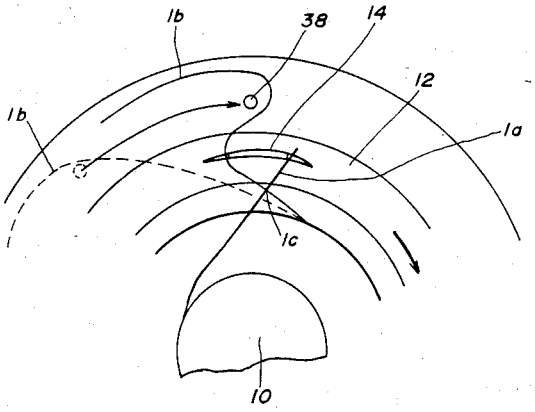
FIG. 13 is a detail which illustrates how the terminating end of the wire is fixed.

In operation, when the wire 1 is fully wound up on the take up spool, it is cut at the position x while it is carried by the distributor 16 as aforementioned. It should be noted that the wire introduction cover 28 is advanced as shown in FIG. 12(A) before the wire 1 is cut. After the wire 1 is cut, the terminating end 1*b* of the wire 1 is introduced by the centrifugal force along the spiral wire guide 32 in the rightward direction as viewed in FIG. 12(B) as the take up spool 10 rotates. It will be understood that, in the embodiment of FIG. 14, the terminating end 1*b* of the wire 1 is introduced by rightward movement of the circular ring 32A driven by the cylinder 35B. Thus, it will be noted that the terminating end 1*b* of the wire 1 is moved close to the catching plate 12. Thereafter, the clutch disengaging plate 48 is advanced to disengage the clutch lever 42 and, at the same time, the spindle 22 for the take up spool 10 is braked. Thus, only the wire drawing plate 34 rotates by inertia force. Since the wire drawing levers 38 are advanced as shown in FIG. 12(C) at the same time that the clutch is disengaged, the terminating end 1*b* of the wire 1 is caught in the catching pawl 14 as shown in FIG. 13 to be caught by the catching pawl 14. The wire drawing levers 38 are braked by the rigidity of the terminating end 1*b* of the wire 1 with the result that the wire drawing plate 34 is stopped.

As the terminating end 1*b* of the wire 1 is caught in this manner, it intersects the initiating end 1*a* of the wire 1 to form the intersected portions 1*c*. Thus, it will be noted that the intersected portions 1*c* of the wire 1 can be fixed to each other to fix the terminating end 1*b* of the wire 1.

Figure 17:
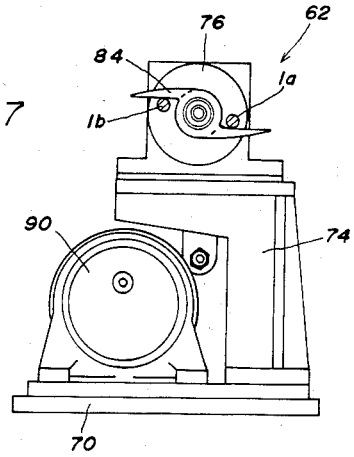
FIG. 17 is an end elevational view of the wire binder of FIG. 15.
Figure 15:
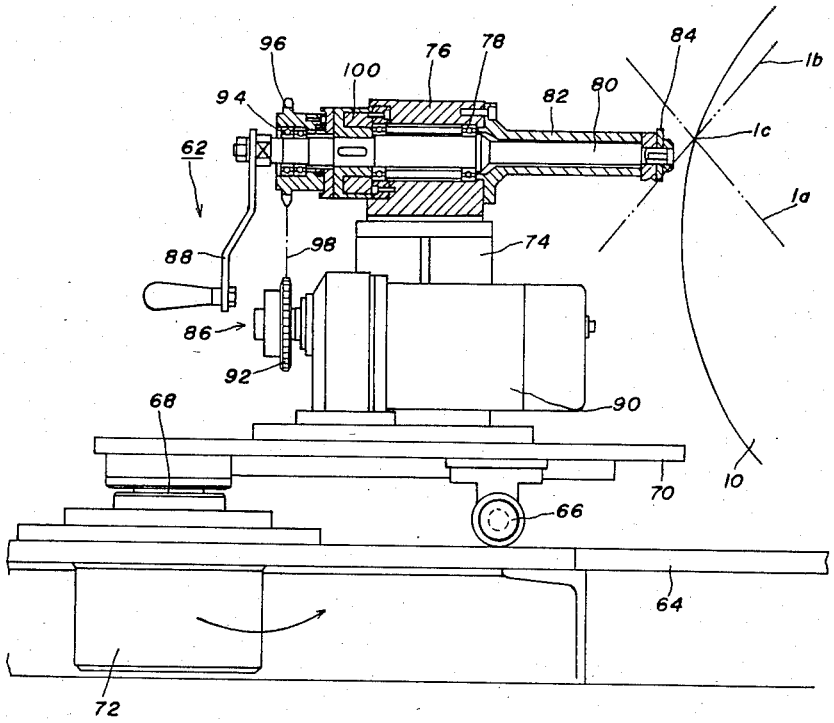
FIG. 15 is a side elevational view of a wire binder used for the apparatus of the invention with a portion sectionally viewed.
Figure 16:
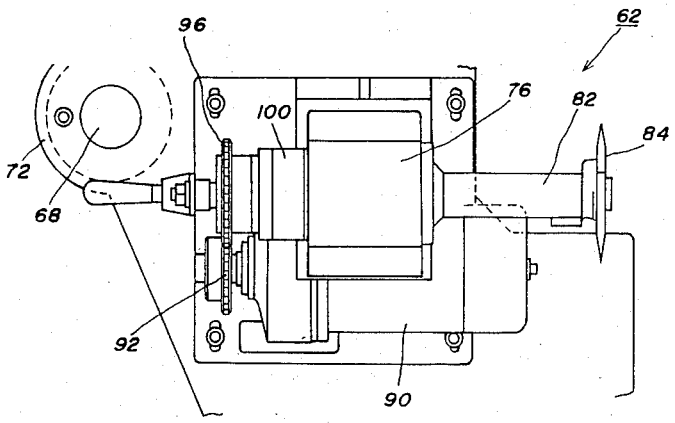
FIG. 16 is a top view of the wire binder of FIG. 16.

FIGS. 15 through 17 show a wire end binder 62 for binding the intersected portions 1*c* of the wire 1. The binder 62 comprises a base 70 supported on a frame 64 and slidably and rotatably moved by a caster 66 about a shaft 68 between an operating position which is close to the wire take up apparatus and a non-operating position which is away from the wire take up apparatus. An electric motor 72 is mounted on the underside of the frame 64 to drive the shaft 68.

A cylindrical case 76 is secured through an auxiliary frame 74 to the base 70. A rotatable shaft 80 is mounted on the cylindrical case 76 through bearings 78. The portion of the rotatable shaft 80 that forwardly protrudes from the cylindrical case 76 has a cylindrical cover 82 screwed to the cylindrical case 76. As shown in FIG. 17, an S-shaped blade 84 is screwed to the front end of the rotatable shaft 80 that protrudes from the cylindrical cover 82. A rotary power source 86 is connected to the rear end of the rotatable shaft 80 which protrudes from the cylindrical case 76 to rotate the rotatable shaft 80.

In the illustrated embodiment, the rotary power source 86 comprises a manual handle 88 connected directly to the rear end of the rotatable shaft 80 and an electric motor 90 mounted on the base 70. The motor 90 has a sprocket 92 mounted thereon. The rotatable shaft 80 has a sprocket 96 rotatably mounted through a bearing 94 at the portion of the shaft 80 in front of the manual handle 88. A chain 98 is provided between the sprockets 92 and 96. A clutch 100 is provided between the rotatable shaft 80 and the sprocket 96. Thus, it will be noted that the blade 84 can be rotated either by the manual handle 88 or by the electric motor 90 when the clutch 100 is engaged.

As aforementioned, after the terminating and initiating ends 1*b* and 1*a* of the wire 1 intersect as shown in FIG. 13, the electric motor 72 of the binder 62 is driven to move the base 70 to the operating position as shown in FIGS. 15 through 17. In this case, since the blade 84 is in the horizontal position as shown in FIG. 17, the blade 84 enters the space between the terminating and initiating ends 1*b* and 1*a* of the wire 1 as the base 70 moves to the operating position. In the operating position, the center of the blade 84 is aligned with the intersecting point 1*c* of the wire ends 1*a* and 1*b*. In this condition, when the manual handle 88 rotates or when the clutch 100 is engaged to drive the electric motor 90, the blade 84 is rotated. Thus, the wire ends 1*a* and 1*b* are twisted about the intersecting point 1*c* to be bound to each other. In this manner, the initiating and terminating ends 1*a* and 1*b* of the wire coil on the take up spool 10 are bound to be fixed to each other. Although, in the illustrated embodiment, the rotary power source 86 for the blade 84 comprises the manual handle 88 and the electric motor 90, it may comprise only one of them.

Although, in the illustrated embodiments, the initiating and terminating ends 1*a* and 1*b* of the wire 1 are fixed to each other by twisting them, they may be fixed either by binding them by adhesive tape or string or by welding or melting them to each other.

While some preferred embodiments of the invention have been illustrated and described with reference to the accompanying drawings, it will be understood by those skilled in the art that they are by way of examples, and that various changes and modifications may be made without departing from the spirit and scope of the invention, which is intended only by the appended claims.

What is claimed is:

1. A method of fixing a terminating end of a coiled wire on a take up spool on a wire take up apparatus which comprises a catching plate integrally rotating with said take up spool and having a catching pawl to catch an initiating end of the wire to be coiled on said take up spool, said method comprising the steps of:

relatively advancing a wire introduction cover and said take up spool so that said spool is within said cover when wire winding on said take up spool nearly ends;

introducing said terminating end of said wire along an inner face of said wire introduction cover to reach said catching plate;

catching said terminating end of said wire with said catching pawl by a wire drawing member on a wire drawing plate which is positioned near said take up spool so that said initiating and terminating ends of said wire intersect on said catching plate;

and fixing intersecting portions of said initiating and terminating ends of said wire to each other.

2. A method of fixing a terminating end of a coiled wire on a take up spool on a wire take up apparatus as set forth in claim 1, wherein said introducing step includes introducing said terminating end of said wire by centrifugal force along a spiral wire guide on the inner face of said wire introduction cover as said take up spool rotates.

3. A method of fixing a terminating end of a coiled wire on a take up spool on a wire take up apparatus as set forth in claim 1, wherein said introducing step includes introducing said terminating end of said wire by a circular ring which is driven by a linear power source.

4. A method of fixing a terminating end of a coiled wire on a take up spool on a wire take up apparatus as set forth in claim 1, wherein said fixing step includes fixing together said intersecting portions of said wire ends by a blade entering between said wire ends and rotating about the intersecting point so that said wire ends are twisted together.

5. An apparatus for securing a terminating end of a coiled wire on a take up spool on a wire take up apparatus which comprises a catching plate integrally rotating with said take up spool and having a catching pawl to catch an initiating end of the wire to be coiled on said take up spool, said apparatus characterized in that said catching pawl has a catching portion to catch said terminating end of said coiled wire and further comprising wire introduction means including a wire introduction cover disposed so as to cover said catching plate and said take up spool and having means to introduce said terminating end of said wire toward said catching pawl so that said initiating and terminating ends of said wire intersect, and a power source to relatively move said wire introduction cover and said spool between an advanced position in which said wire introduction cover surrounds said take up spool and a retracted position in which said take up spool is relieved out of said wire introduction cover; and means to fix intersecting portions of said initiating and terminating ends of said wire to each other.

6. An apparatus for fixing a terminating end of a coiled wire on a take up spool on a wire take up apparatus as set forth in claim 5, wherein said wire introduction cover has a spiral wire guide provided in the inner face thereof to introduce said terminating end of said wire as said take up spool rotates.

7. An apparatus for fixing a terminating end of a coiled wire on a take up spool on a wire take up apparatus as set forth in claim 5, wherein said wire introduction means further comprises a circular ring connected to a linear power source to move said terminating end of said wire along inner face of said wire introduction cover.

8. An apparatus for fixing a terminating end of a coiled wire on a take up spool on a wire take up apparatus as set forth in claim 5, wherein said catching portion of said catching pawl to catch said terminating end of said wire is provided integrally with the initiating end catching portion.

9. An apparatus for fixing a terminating end of a coiled wire on a take up spool on a wire take up apparatus as set forth in claim 5, wherein said catching portion of said catching pawl to catch said terminating end of said wire is separately provided from the initiating end catching portion.

10. An apparatus for fixing a terminating end of a coiled wire on a take up spool on a wire take up apparatus as set forth in claim 5, and further comprising wire drawing means to draw up said terminating end of said wire toward said catching portion of said catching pawl.

11. An apparatus for fixing a terminating end of a coiled wire on a take up spool on a wire take up apparatus as set forth in claim 10, wherein said wire drawing means comprises a wire drawing plate disposed coaxially of said take up spool and rotatably supported outside of said catching plate, a clutch to engagably join said wire drawing plate with said catching plate, and wire drawing lever means retracted when said clutch is engaged and advanced to catch said terminating end of said wire into said catching portion of said catching pawl when said clutch is disengaged.

12. An apparatus for fixing a terminating end of a coiled wire on a take up spool on a wire take up apparatus as set forth in claim 11, wherein said clutch comprises clutch lever means pivotally supported on said wire drawing plate and normally spring-urged so as to frictionally engage said catching plate and a clutch disengaging plate disposed to force said clutch lever means at the rear end thereof and advanced to disengage said clutch against spring-urging.

13. An apparatus for fixing a terminating end of a coiled wire on a take up spool on a wire take up apparatus as set forth in claim 12, wherein said wire drawing lever means is secured to a rotatable shaft which pivotally supports said clutch lever means.

14. An apparatus for fixing a terminating end of a coiled wire on a take up spool on a wire take up apparatus as set forth in claim 5, wherein said means to fix intersecting portions comprises a base, a case mounted on said base, a rotatable shaft rotatably supported on said case, a blade mounted on said rotatable shaft at the front portion protruding from said case to enter the intersecting point of said terminating and initiating ends of said wire, and a rotary power source connected to said rotatable shaft at the rear portion protruding from said case.

15. An apparatus for fixing a terminating end of a coiled wire on a take up spool on a wire take up apparatus as set forth in claim 14, wherein said rotary power source comprises a manual handle connected to said rotatable shaft at the rear end thereof.

16. An apparatus for fixing a terminating end of a coiled wire on a take up spool on a wire take up apparatus as set forth in claim 14, wherein said rotary power source comprises an electric motor connected through a power transmission to said rotatable shaft at the rear portion thereof.

17. An apparatus for fixing a terminating end of a coiled wire on a take up spool on a wire take up apparatus as set forth in claim 14, wherein said rotary power source comprises a manual handle directly connected to said rotatable shaft at the rear end thereof and an electric motor connected through a power transmission to said rotatable shaft at the rear end thereof.

* * * * *

UNITED STATES PATENT AND TRADEMARK OFFICE

CERTIFICATE OF CORRECTION

PATENT NO. : 4,552,314

DATED : November 12, 1985

INVENTOR(S) : Masahisa Noguchi

It is certified that error appears in the above—identified patent and that said Letters Patent is hereby corrected as shown below:

Column 2, line 50, "16" (second occurrence) should be --15--
Column 4, line 49, after "spool" insert --10--

Signed and Sealed this

*Ninth* Day of *September 1986*

[SEAL]

*Attest:*

DONALD J. QUIGG

*Attesting Officer*

*Commissioner of Patents and Trademarks*